United States Patent [19]

Kishida et al.

[11] Patent Number: 4,888,272

[45] Date of Patent: Dec. 19, 1989

[54] METHOD FOR PREPARING SILVER HALIDE PHOTOGRAPHIC EMULSIONS

[75] Inventors: Seiichiro Kishida; Minoru Sato, both of Kanagawa, Japan

[73] Assignee: Fuji Photo Film Co., Ltd., Kanagawa, Japan

[21] Appl. No.: 175,998

[22] Filed: Mar. 31, 1988

[30] Foreign Application Priority Data

Mar. 31, 1987 [JP] Japan ..... 62-79482

[51] Int. Cl.[4] ..... G03C 1/02

[52] U.S. Cl. ..... 430/569; 430/567; 430/599

[58] Field of Search ..... 430/567, 569, 599

[56] References Cited

U.S. PATENT DOCUMENTS 4,471,050 9/1984 Maskasky ..... 430/567
4,643,966 2/1987 Maskasky ..... 430/567
4,684,607 8/1987 Maskasky ..... 430/567
4,735,894 4/1988 Ogawa ..... 430/569

OTHER PUBLICATIONS

James, "The Theory of the Photographic Process 4th ed.", 1977, p. 23.

*Primary Examiner*—Paul R. Michl
*Assistant Examiner*—Mark R. Buscher
*Attorney, Agent, or Firm*—Sughrue, Mion, Zinn, Macpeak, and Seas

[57] ABSTRACT

A method for preparing a silver halide photographic emulsion is disclosed, comprising silver halide grains having silver halide protrusions on the surface of the silver halide grain matrix, wherein the silver halide grain matrix is chemically sensitized and then the silver halide protrusions are formed on the surface of the thus chemically sensitized silver halide grain matrix.

11 Claims, No Drawings

METHOD FOR PREPARING SILVER HALIDE PHOTOGRAPHIC EMULSIONS

FIELD OF THE INVENTION

The present invention relates to a method for preparing silver halide photographic emulsions, and in particular, to a method for preparing silver halide photographic emulsions comprising silver halide grains having an enlarged specific surface area so that the grains may be advantageously spectrally sensitized.

BACKGROUND OF THE INVENTION

Spectral sensitization of silver halide photographic emulsions is an extremely important and indispensable technique for preparing photographic light-sensitive materials which have a high sensitivity and which are excellent in color reproducibility. For the purpose of providing photographic light-sensitive materials having a high sensitivity, various spectral sensitizers have heretofore been developed and additionally, the technical development of the use of spectral sensitizers, for example, for super color sensitization with spectral sensitizers or for advantageous addition of spectral sensitizers has also been performed. A spectral sensitizer can absorb even light with a long wavelength range, which inherently is not substantially absorbed by silver halide photographic emulsions, and has an action of transmitting the light absorption electron and/or the light absorption energy to silver halides. Accordingly, the increase of the amount of the light trapped by the spectral sensitizer may be advantageous for elevating the photographic sensitivity of photographic emulsions. Under the situation, not only a trial of developing spectral sensitizers having an elevated light absorption coefficient but also a trial of increasing the amount of the spectral sensitizer to be added to silver halide emulsions to thereby elevate the amount of the light to be trapped by the spectral sensitizer have been performed.

Accordingly, improvement and development of means of increasing the amount of spectral sensitizers to be added to silver halide emulsions as well as improvement and development of preparation of such silver halide grains capable of accepting an increased amount of spectral sensitizers have variously been tried up to the present.

For example, Thomas L. Penner & P. B. Gilman Jr., *Photographic Science and Engineering,* 20 (3), 97–106 (1976) has proposed a means of stratiform-absorbing a large amount of two different spectral sensitizers which are in a pertinent potential relation to silver halide crystals to thereby increase the amount of light to be trapped by the spectral sensitizers while the desensitization caused by the large addition of the spectral sensitizers is suppressed. In addition, a trial of improving the silver halides themselves has also been performed. One improvement is to use tabular silver halide grains having a large specific surface area, which is disclosed in Japanese patent application (OPI) Nos. 113926/83, 113927/83, 113930/83, 113934/83, 111934/83, 95337/83, 108528/83, 108526/83, etc. (The term "OPI" as used herein means a "published unexamined patent application".)

On the other hand, C. R. Berry & D. C. Skillman, *J. Appl. Phys.,* 35, 2165–2169 (1964) and J. E. Maskasky's Japanese patent application (OPI) No. 133540/84 mention silver bromide grains having silver chloride epitaxially grown on the surface of the base grain.

Although the examples of these grains are not naturally intended to increase the specific surface are of the grains, this is one method of increasing the specific surface area of silver halide grains.

However, all of these grains could not be expected to sufficiently increase the specific surface area of the grains as compared with grains having the same size but having no protrusions, since the size of the protrusions epitaxially grown on the surface of the base grains is too large and/or the number of the protrusions per unit area is too small.

Small protrusion are advantageous with respect to the enlargement of the specific surface area. Accordingly, a means of first forming smaller protrusions on the surface of base grains and then stabilizing the resulting grains in the subsequent process, especially during chemical sensitization of the grains, has been tried, and for example, Japanese patent application No. 300410/86 (corresponding to U.S. patent application Ser. No. 133,974 filed on December 17, 1987) discloses a method for stabilizing the grains with a grain formation-stopping agent prior to the chemical sensitization of the grains.

However, the addition of the grain formation-stopping agent before chemical sensitization resulted in a noticeable limitation in the successive process (especially in the chemical sensitization step).

For example, when the variation of the shape of the grains is stopped by the addition of a mercapto compound (especially, 1-phenyl-5-mercaptotetrazole) prior to chemical sensitization of the grains, the chemical sensitization would be extremely retarded or fog would often increase. Moreover, the subsequent spectral sensitization step would also become disadvantageous, as the adsorption of dyes would be inhibited or formation of association products would be inhibited.

Therefore, Japanese patent application No. 300410/86 mentions that a dye having both a grain formation-stopping function and a spectrally sensitizing function is preferably used so as not to impart any adverse influence to the spectral sensitization step.

However, the optimal dye capable of acting as a grain formation-stopping agent does not always correspond to the optimal dye capable of acting as a spectral sensitizer, and therefore, in most cases the degree of freedom for the selection of the dyes for spectral sensitization is reduced or the photographic characteristics such as color-sensitivity, etc., are sacrificed.

Moreover, since a large amount of the grain formation-stopping agent is added, a large amount of an organic solvent would thereby have to be used in most cases, and as a result, the handling of the subsequent process would often be extremely difficult, particularly when the operation of rinsing with water is successively required.

SUMMARY OF THE INVENTION

Accordingly one object of the present invention is to provide a method for preparing a silver halide photographic emulsion comprising silver halide grains which have a large specific surface area and which are suitable for spectral sensitization, on the basis of a novel technical idea which is quite different from that for preparation of tabular grains, and the silver halide photographic emulsion is advantageously incorporated into silver halide photographic materials.

This and other objects of the present invention can be attained by a method of preparing a silver halide photographic emulsion comprising silver halide grains having silver halide protrusions on the surface of hte silver halide grain matrix, wherein the silver halide grain matrix is chemically sensitized and then the silver halide protrusions are formed on the surface of the thus chemically sensitized silver halide grain matrix.

DETAILED DESCRIPTION OF THE INVENTION

The silver halide emulsion of the present invention can be prepared by a combination of various methods which are known in the field of silver halide photographic materials. Specifically, after the grain matrixes are formed and then chemically sensitized, the protrusions are formed on the surface of the chemically sensitized grain matrixes, to give the intended silver halide emulsion of the present invention. Although the step of rinsing in water for desalting can be carried out at any stage during the formation of the silver halide grains, it is preferred that the rinsing-in-water step is carried out before the formation of the protrusion, that is, after the formation of the grain matrixes or after the chemical sensitization of the grain matrixes.

For the formation of the grain matrixes, various methods can be employed, for example, including an acidic method, a neutral method, and an ammonia method, as well as a single jet method, a double jet method, and a combination thereof in which a soluble silver salt and a soluble halogen salt are reacted. As one system of the double jet method, a so-called controlled double jet method of keeping a constant pAg in the liquid phase for forming silver halide grains can be employed. As another system of the double jet method, a so-called triple jet method of independently adding soluble halogen salts each having a different composition (for example, a soluble silver salt, soluble bromide and soluble iodide) can also be employed. A silver halide solvent such as ammonia, rhodane salts, thioreas, thioethers, amines, etc. can selectively be used for preparation of the grain matrixes. The halogen composition of the grain matrixes is preferably uniform. The determination as to whether the halogen composition of the individual grain matrix is uniform or not can be carried out by X-ray diffraction or the EPMA (Electro Probe Micro Analyzer) method. When the halogen composition of the grain matrixes is more uniform, the X-ray diffraction width is narrow and gives a sharp peak.

The grain size distribution of the grain matrixes may be either narrow or broad, but one preferred embodiment of the grain matrixes is a monodispersed emulsion having a narrow grain size distribution (having a variation coefficient of 20% or less).

Regarding the size of the grain matrixes, the mean value of the diameter of the projected area of the respective grain matrixes is preferably 0.5 μm or more, more preferably 0.7 μm or more, and most preferably 1.0 μm to 10 μm.

The grain matrixes in which a (111) plane constitutes 50% or more of the total surface of the grain matrixes are preferred. Particularly, the grain matrixes in which a (111) plane consitutes 75% or more are preferably used. Regarding the shape of the grain matrixes, tabular grains having a high aspect ratio (projected area diameter/grain thickness), for example having an aspect ratio of from 5/1 to 20/1, are preferred, but a tetradecahedral, octahedral or irregular shaped twin grains can be used as the grain matrix as long as the (111) plane constitutes 50% or more of the total grain surface area. In addition, the use of monodispersed tabular grains as the grain matrixes often results in a more favorable result.

The tabular grains which can be used as the grain matrixes in the present invention can easily be prepared by the methods described in Gutoff, *Photographic Science and Engineering,* Vol. 14, pages 248–257 (1970); and U.S. Pat. Nos. 4,434,226, 4,414,310, 4,433,048, and 4,439,520, British Pat No. 2,112,157, Japanese patent application (OPI) No. 127921/83, etc. The structure of monodispersed tabular grains for the grain matrixes of the present invention and the method of preparing the grains may follow the description of Japanese patent application No. 299155/86. The shape of the monodispersed tabular grain matrixes will be discussed below briefly. In the monodispersed emulsion, hexagonal tabular silver halide grain matrixes which have a ratio of the length of the longest edge to that of the shortest edge of 2 or less and which have two parallel outer surfaces constitute 70% or more of the total projected are of the silver halide grain matrixes, the variation coefficient of the grain size distribution of the hexagonal tabular silver halide grains (value of the standard deviation of the grain size as represented by the diameter of the circle based on the projected area of the grain, divided by the mean grain size is 20% or less, the aspect ratio of the grains in the monodispersed emulsion is 2.5 or more and the grain size thereof is 0.2 μm or more.

The other tetradecahedral, octahedral or irregular twin plane grains can also be prepared with ease, by reference to the description of T H. James, *The Theory of the Photographic Process,* 4th Ed. (published by Macmillan), Chap. 3, pages 88 to 104, etc.

The plane proportion of the (111) plane in the grain matrixes can be determined by Kubelka-Munk's dye absorption method. For example, the method is described in *Journal of Imaging Science,* 29, 165–171 (1985), in which a dye, which can adsorb preferentially to either a (111) plane or a (100) plane and the dye association on the (111) plane is spectrally different from that on the (100) plane, is selected and is added to the emulsion to be examined and the variation of the resulting spectrum is examined in detail with respect to the amount of the dye added to the emulsion, whereby the plane proportion of (111) plane is the base grains can be obtained.

In the practice of the present invention, a cadmium salt, a zinc salt, a lead salt, a thallium salt, an iridium salt or a complex salt thereof, a rhodium salt or a complex salt thereof, an iron salt or a complex salt thereof, etc. can be added to the grain matrixes, during the formation of the grains or physical ripening thereof.

The grain matrixes of the present invention are chemically sensitized prior to formation of the protrusions thereon. For the chemical sensitization, for example, the method described in H. Frieser, *Die Grundlagen der Photographischen Prozesse mit Silverhalogeniden* (published by Akademische Verlagsgesellschaft, 1968), pages 675–734, can be employed. Specifically, a sulfur sensitization method using an active gelatin or a sulfur-containing compound capable of reaction with silver (e.g., thiosulfates, thioureas, mercapto compounds, rhodanines, etc.); a selenium sensitization method; a reduction sensitization method using a reducing substance (e.g., stannous salts, amines, hydrazine derivatives, formamidine-sulfinic acids, silane compounds, etc.); a noble metal sensitization method using a noble metal (e.g., gold complexes and complex salts of metals belonging to Group VIII of the Periodic Table, such as platinum, iridium, palladium, etc.), etc. can be used alone or in combination, Among these, preferred methods of chemical sensitization are noble metal sensitization method using gold complexes, a sulfur sensitization method using an active gelatin or a sulfur-containing compound, or combination thereof.

Specific examples of the sulfur sensitization methods are described in U.S. Pat. Nos. 1,574,944, 2,410,689, 2,278,947, 2,728,668, 3,656,955, etc.; those of the selenium sensitization methods are described in U.S. Pat. Nos. 1,574,944, 1,602,592, 1,623,499, etc.; those of the reduction sensitization method are described in U.S. Pat. Nos. 2,983,609, 2,419,974, 4,054,458, etc.; and those of the noble metal sensitization method are described in U.S. Pat. Nos. 2,399,083 and 2,448,060, British Pat. No. 618,061, etc.

In addition, a method of chemical sensitization in the presence of an inhibitor such as 4-hydroxy-1,3,3*a*, 7-tetrazaindene, etc. (as described in Japanese patent application (OPI) No. 126526/83) and a method of selective chemical sensitization of specific parts of silver halide grains by retarding the addition speed of the sensitizer (as described in Japanese patent application (OPI) No. 93447/86) are often advantageous, as resulting in an especially favorable result.

The formation of the protrusion is preferably carried out by adding a water-soluble silver salt and water-soluble halogen salts which correspond to the composition of the protrusions to be formed. The addition of the water-soluble silver salt for the formation is preferably carried out at such high speed that formation of nuclei does not occur.

It is desired that the formation of the protrusions is carried out at a high silver potential level of at least preferably about +110 mV or more, more preferably about +120 mV to +500 mV, most preferably about +350 mV to +500 mV, although the level may vary somewhat depending on the halogen composition of the protrusions to be formed, and/or the temperature during the formation, and/or the additives to be added during the formation, etc. In the present invention, the silver potential is measured by a saturated calomel electrode (SCE) hereinafter, unless specifically stated otherwise.

The temperature during the step of the formation of the protrusions is preferably low and is generally 80° C. or lower, preferably 70° C. or lower, more preferably 65° C. or lower, although this may vary somewhat depending on the other conditions during the formation.

Although the existence of additive which may be a silver halide solvent during the formation of the protrusions is not preferable, the additives can be used within the range that the grain matrixes and the protrusions are not intermingled with each other more than necessary.

The structure of the silver halide grains for use in the present invention comprises the chemically sensitized grain matrix parts and the protrusion parts.

When the present invention is applied to the preparation of negative emulsions, the preferred embodiments between the sensitizing nuclei to be formed on the grain matrixes by the chemical sensitization thereof and the protrusion parrts are as follows.

One embodiment is that the position where the sensitizing nucleus is formed differs from that where the protrusion is formed.

Another embodiment is that the sensitizing nuclei on the surface of the grain matrix are covered with the protrusions which are easily dissolved during development.

The preferred embodiments will be explained in detail hereunder.

It is preferred that the halogen composition of the grain matrixes differs from that of the protrusions, and preferred halogen compositions for the grain matrixes comprises AgBr or AgBrI containing preferably 10 mol % or less $I^{\ominus}$ (i.e., iodide ion). A small amount (i.e., 5 mol % or less) of silver chloride may be incorporated into the grain matrixes.

Preferred compositions of the protrusions are AgBr, AgBrCl and AgCl. More preferably, the composition comprises AgBrCl or AgCl containing 30 mol % or more $Cl^{\ominus}$ (chloride ion), and particularly preferably the composition comprises AgBrCl or AgCl containing preferably 50 mol % or more $Cl^{\ominus}$ (i.e., chloride ion) and more preferably 75 mol % or more $Cl^{\ominus}$. It is preferred that silver iodide is absent in the composition, but a small amount (i.e., 2 mol % or less) of silver iodide may be incorporated into the composition.

Regarding the combination of the halogen composition of the grain matrixes and that of the protrusions, it is preferred that the grain matrixes comprise AgBrI containing 10 mol % or less AgI and the protrusions comprise AgBrCl containing 50 mol % or more AgCl.

In the photographic emulsion of the present invention, the silver halide grains having the protrusions constitute generally 50% or more, preferably 70% or more, more preferably 90% or more, of the total projected area of the total silver halide grains in the emulsion.

The protrusions formed on the grain matrixes of the present invention have a size, as the diameter of the projected area of the protrusion, of generally 0.15 μm or less, preferably 0.13 μm or less, more preferably from 0.01 to 0.11 μm. The "diameter of the projected area" is represented by the diameter of the circle having the same surface area as the projected area of the protrusion from the top of the protrusion. The number of the protrusion per unit area ($\mu m^2$) of the grain matrix is generally from 10 to $1\times10^4$, preferably from 20 to $1\times10^4$, more preferably from 3 to $1\times10^4$.

As the protective colloid to be used for the preparation of the emulsion of the present invention, gelatin is advantageously used, but other hydrophilic colloids can also be used. Gelatin, lime-processed gelatin as well as acid-processed gelatin or the enzyme-processed gelatin described in *Bull. Soc. Sci. Phot. Japan,* No. 16, page 30 (1966) can be used. Also, the hydrolyzed products or enzyme decomposed products of gelatin can be used.

Various compounds can be incorporated in the photographic emulsions to be used in the present invention, for the purpose of preventing fog during the process of preparation, preservation for use or photographic processing of the light-sensitive material, or of stabilizing photographic performance. For example, many compounds known as antifoggants or stabilizers, e.g., azoles such as benzothiazolium salts, nitroindazoles, nitrobenzimidazoles, chlorobenzimidazoles, bromobenzimidazoles, mercapthothiazoles, mercaptobenzothiazoles, mercaptobenzimidazoles, mercaptothiadiazoles, aminotriazoles, benzotriazoles, nitrobenzotriazoles, and mercaptotetrazoles (particularly 1-phenyl-5-mercaptotetrazole); mercaptopyrimidines; thioketo compounds such as oxazolinethione; azaindenes such as triazaindenes, tetraazaindenes (particularly 4-hydroxy substituted (1,3,3a,7)-tetraazaindenes), and pentaazaindenes; benzenethiosulfonic acid, benzenesulfinic acid and benzenesulfonic acid amide can be added. For example, the compounds described in U.S. Pat. Nos. 3,954,474, 3,982,947 and Japanese Patent Publication No. 28660/77 can be used.

In the photographic emulsion layer of the photographic material of the present invention, for the purpose of increasing sensitivity or contrast, or of accelerating development, a polyalkylene oxide or its derivatives (e.g., ethers, esters and amines), thioether compounds, thiomorpholines, quaternary ammonium salt compounds, urethane derivatives, urea derivatives, imidazole derivatives, and 3-pyrazolidones may be incorporated. For example, the compounds described in U.S. Pat. Nos. 2,400,532, 2,423,549, 2,716,062, 3,617,280, 3,772,021, 3,808,003, and British Pat. No. 1,488,991 can be used.

The silver halide emulsion of the present invention is spectrally sensitized.

Methine dyes which are used in the present invention for spectral sensitization are described in, for example, F. M. Hamer, *The Chemistry of Heterocyclic Compounds,* Vol. 18, A. Weissberger ed., *The Cyanine Dyes and Related Compounds,* (Interscience Inc., New York, 1964), D. M. Sturmer, *The Cyanine Dyes and Related Compounds,* A. Weissberger, E. C. Taylor ed., John Willey Co., New York (1977), *Research Disclosure,* Vol. 176, No. 17643, pp. 23 to 24 (1978), German Pat. No. 929,080, U.S. Pat. Nos. 2,231,658, 2,493,748, 2,503,776, 2,519,001, 2,912,329, 3,656,959, 3,572,897, 3,694,217, 4,025,349, 4,046,572, British Pat. No. 1,242,588, Japanese Patent Publication Nos. 14030/69, 24844/77, British Pat. Nos. 584,609, 1,177,429, Japanese patent application (OPI) Nos. 85130/73, 99620/74, 11442/74, 108115/77, U.S. Pat. Nos. 2,274,782, 2,533,472, 2,956,879, 3,148,187, 3,177,078, 3,247,127, 3,540,887, 3,575,704, 3,653,905, 3,718,472, 4,071,312 and 4,070,352.

These spectral sensitizers can be used alone or in combination with each other. Combinations of spectral sensitizers are often used for the purpose of super-sensitization.

In combination with spectral sensitizers, dyes not having a spectral sensitization action by themselves or substances substantially not absorbing visible light and exhibiting supersensitization can be used. For example, aminostylbene compounds substituted by a nitrogen-containing heterocyclic group (as described in, for example, U.S. Pat. Nos. 2,933,390, and 3,635,721), aromatic organic acid-formaldehyde condensates (as described in, for example, U.S. Pat. No. 3,743,510), cadmium salts, azaindene compounds, etc. may be incorporated. The combinations described in U.S. Pat. Nos. 3,615,613, 3,615,641, 3,617,295 and 3,635,721 are particularly useful.

Typical examples of dyes which are used as spectral sensitizers in the present invention are shown below, but the present invention is not to be construed as being limited thereto.

D-1

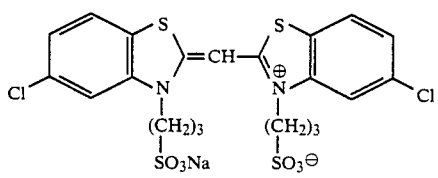

D-2

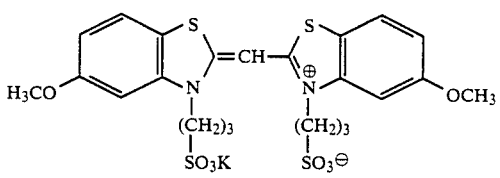

D-3

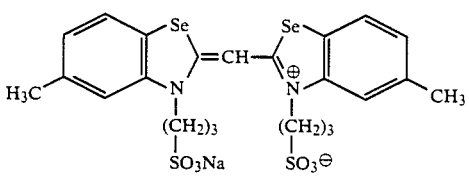

D-4

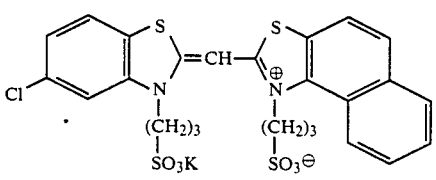

-continued
D-5
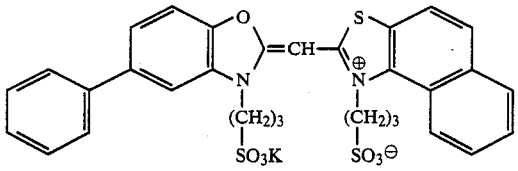
D-6
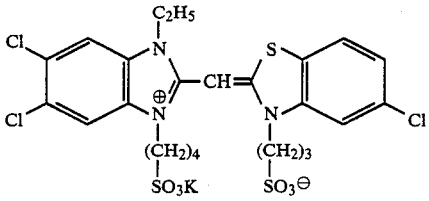
D-7
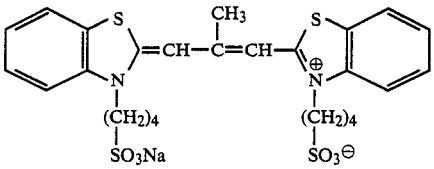
D-8
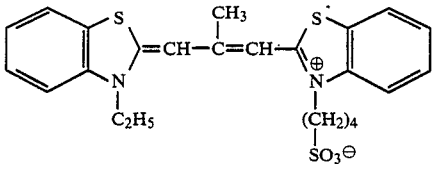
D-9
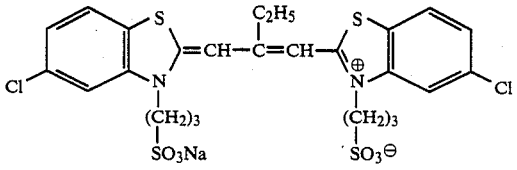
D-10
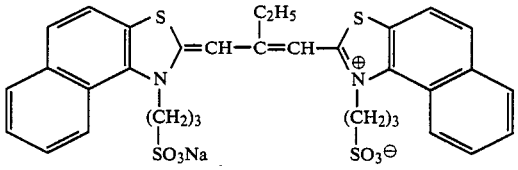
D-11
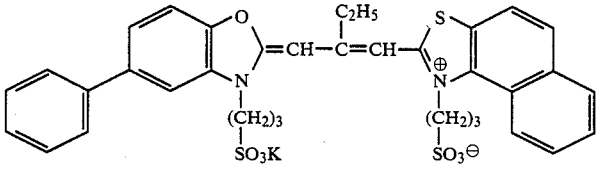
D-12
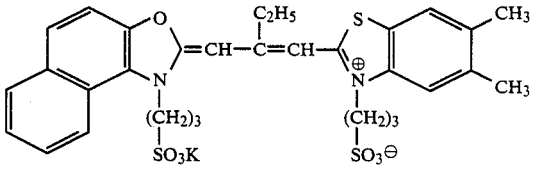

-continued
D-13
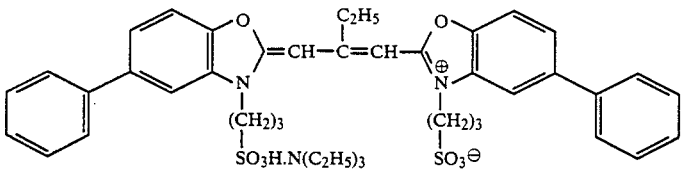
D-14
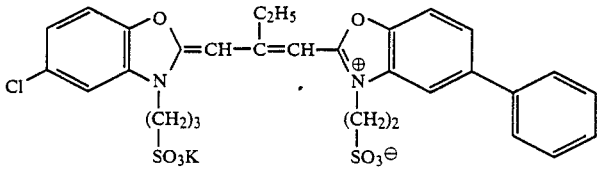
D-15
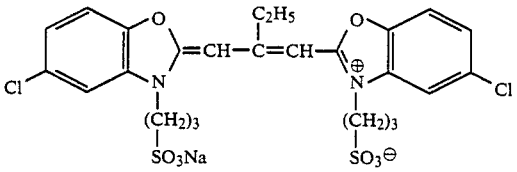
D-16
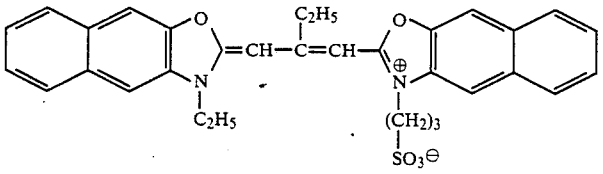
D-17
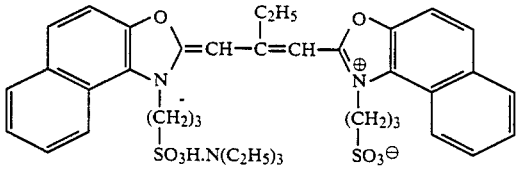
D-18
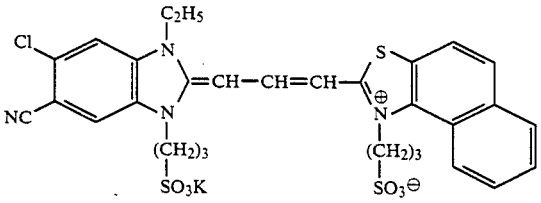
D-19
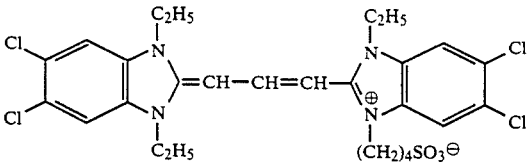
D-20
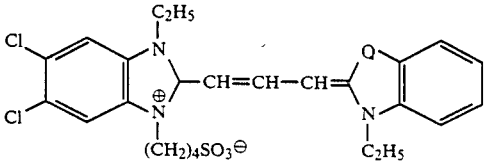

-continued
D-21
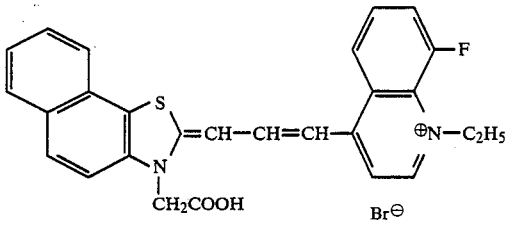
D-22
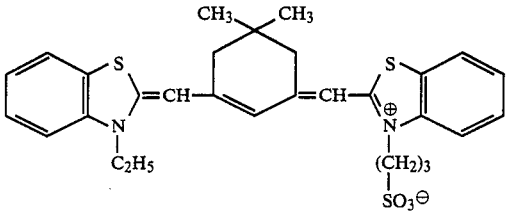
D-23
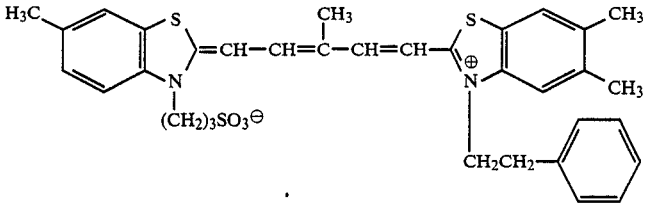
D-24
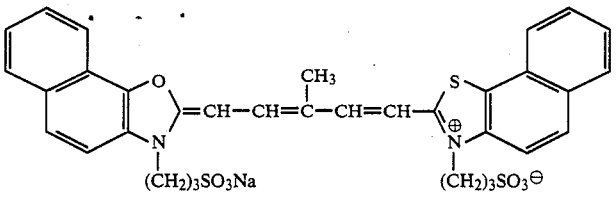
D-25
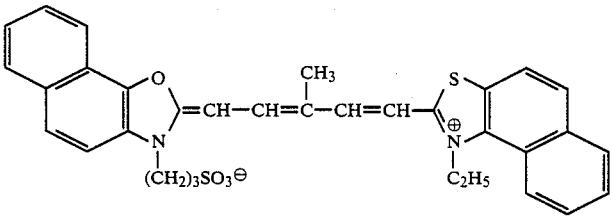
D-26
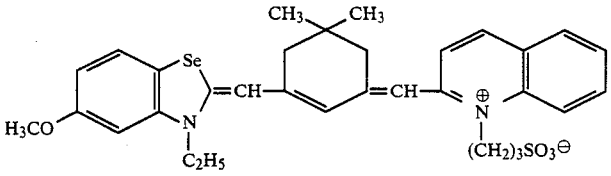
D-27
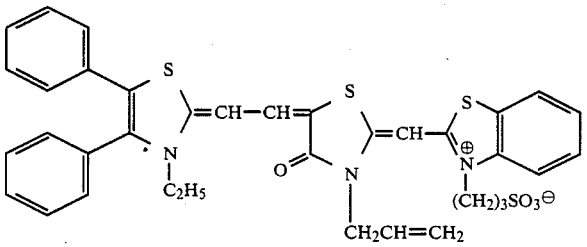

-continued
D-28
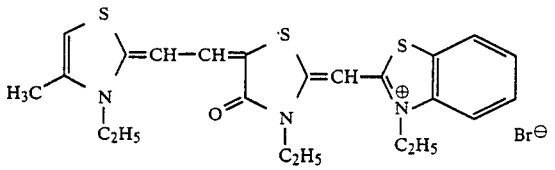
D-29
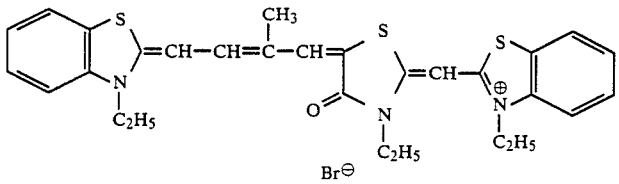
D-30
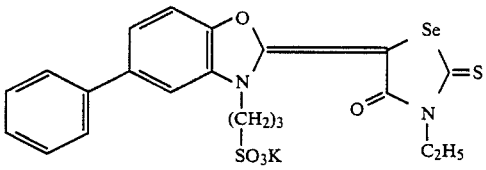
D-31
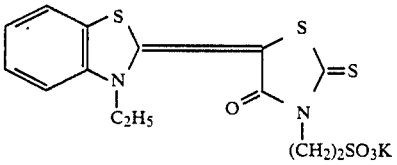
D-32
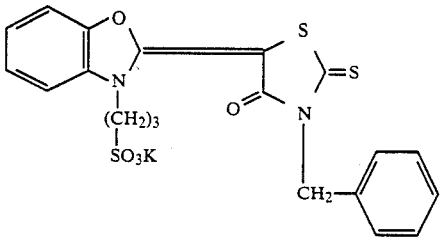
D-33
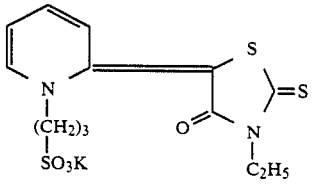
D-34
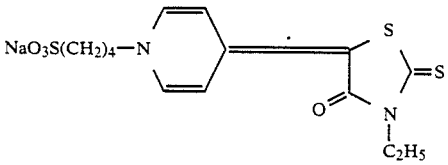
D-35
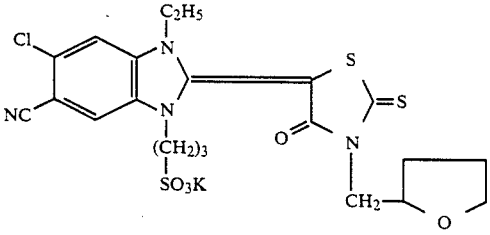

-continued
D-36
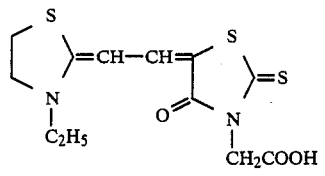
D-37
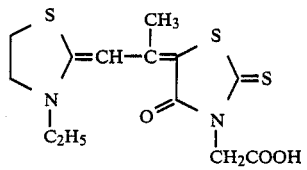
D-38
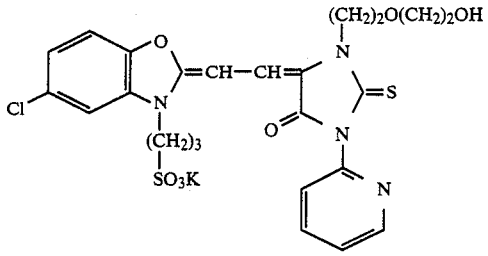
D-39
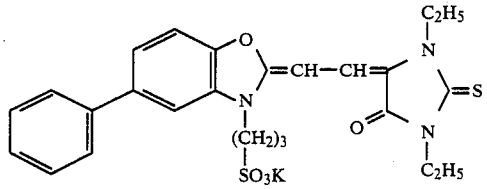
D-40
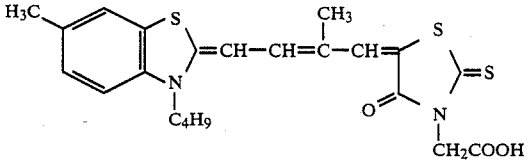
D-41
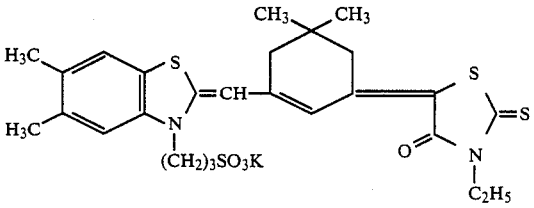
D-42
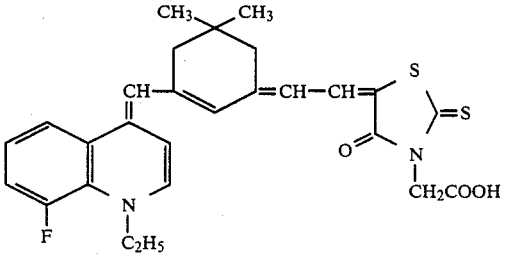

-continued

D-43

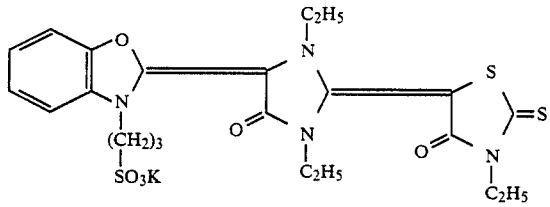

D-44

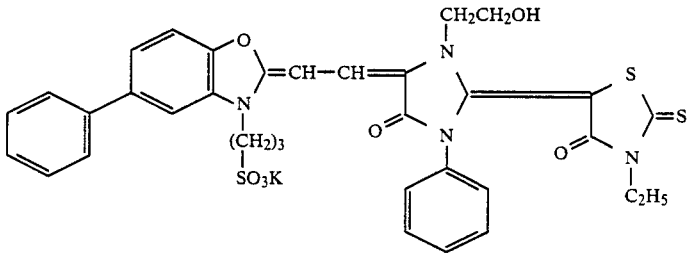

D-45

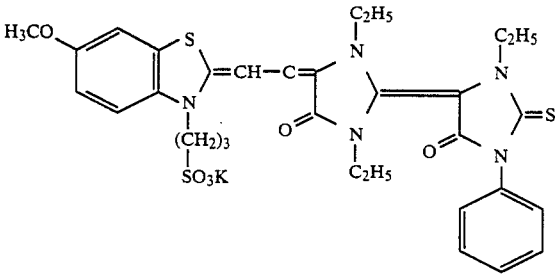

To the photographic light-sensitive materials of the present invention can be added the above-mentioned various additives, and in addition, other various kinds of additives can also be added to the materials depending on the object and the use thereof.

These additives are described in greater detail in *Research Disclosure,* RD No. 17643 (December, 1978) and *ibid.,* RD No. 18716 (November, 1979), and the related parts are summarized below.

| No. | Additives | RD 17643 | RD 18716 |
|---|---|---|---|
| 1. | Chemical Sensitizers | p. 23 | p. 648, right column |
| 2. | Sensitivity Increasing Agents | — | p. 648, right column |
| 3. | Spectral Sensitizers and Supersensitizers | pp. 23–24 | from p. 648, right column to p. 649, right column |
| 4. | Brightening Agents | p. 24 | — |
| 5. | Antifoggants and Stabilizers | pp. 24–25 | p. 649, right column |
| 6. | Light Absorbents, Filter Dyes, and Ultraviolet Absorbents | pp. 25–26 | from p, 649, right column to p. 650, left column |
| 7. | Stain Preventing Agents | p. 25, right column | p. 650, from left to right column |
| 8. | Dye Image Stabilizers | p. 25 | — |
| 9. | Hardeners | p. 26 | p. 651, left column |
| 10. | Binders | p. 26 | p. 651, left column |
| 11. | Plasticizers and Lubricants | p. 27 | p. 650, right column |
| 12. | Coating Aids and Surfactants | pp. 26–27 | p. 650, right column |
| 13. | Antistatic Agents | p. 27 | p. 650, right column |
| 14. | Color Couplers | p. 25 | p. 649, right column |

-continued

U.S. Pat. Nos. 4,643,966 mentions as a technique similar to the present invention, but this is silent about the means of forming protrusions on the surface of silver halide grain matrixes after the chemical sensitization of the said grain matrixes. In the invention of the U.S. Patent, it is indispensable to form protrusions having a composition which favors the silver halide grain matrixes (or that is, the protrusions could not be formed unless the grain matrixes are specifically treated), and all the examples of the Patent refer to only the formation of AgBr or AgBrI protrusions on AgBr or AgBrI grain matrixes respectively. Accordingly, the present invention is quite different from the invention of the U.S. Patent in that the grain matrixes are first chemically sensitized and then protrusions are formed on the surface of the thus chemically sensitized grain matrixes so that the protrusions can stably be formed in the present invention.

The following examples are intended to illustrate the present invention but not to limit it in any way.

Unless otherwise specified, all rates, percents, etc., are by weight.

EXAMPLE 1

A silver nitrate solution and a potassium bromide solution were added with stirring by the double jet method to a solution containing potassium bromide and gelatin maintained at 70° C. After the completion of the addition, the temperature was lowered to 35° C. and the soluble salts were removed by a sedimentation method.

Afterwards, the temperature was again elevated to 40° C., and 60 g of gelatin was added and dissolved, and the pH value was adjusted to 6.8, to form a grain matrix emulsion A. The thus prepared grain matrixes were tabular and had an average diameter of 4 μm and a mean thickness of 0.2 μm.

sions having a diameter of the projected area of 0.15 μm or less.

Next, the emulsion layer and the protective layer as described below were formed on a triacetyl cellulose film (support) coated with a subbing layer, to prepare coated sample Nos. 1 to 3.

(1) Emulsion Layer:
Emulsion: One of Emulsions 1 to 3
($2.1 \times 10^{-2}$ mol/m$^2$ as silver
Coupler:

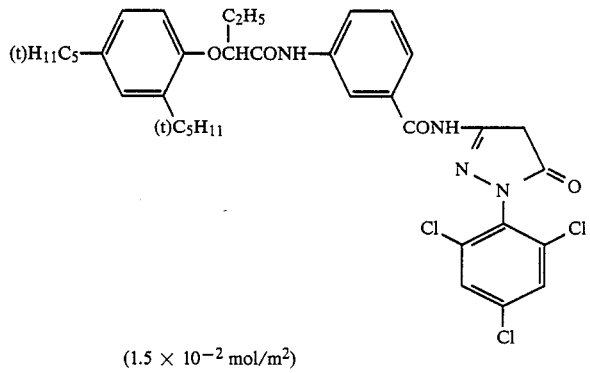

($1.5 \times 10^{-2}$ mol/m$^2$)

| | |
|---|---|
| Tricresyl Phosphate | (1.10 g/m$^2$) |
| Gelatin | (2.30 g/m$^2$) |
| (2) Protective Layer: | |
| 2,4-Dichlorotriazine-6-hydroxy-s-triazine Sodium Salt | (0.08 g/m$^2$) |
| Gelatin | (1.80 g/m$^2$) |

200 ml of water was added to 900 g of the Emulsion A (which corresponds to 70 g of $AgNO_3$) and kept at 50° C., and then an aqueous silver nitrate solution (corresponding to 7 g of $AgNO_3$) and an aqueous sodium chloride solution were added thereto by a double jet method keeping the silver potential at +160 mV, whereby protrusions were formed on the surface of the grain matrixes.

Next, the emulsion thus-prepared was chemically sensitized with a hypo (i.e., sodium thiosulfate) for 20 minutes at 50° C., and 120 ml of 1/250 mol/l Dye D-13 mentioned above was added thereto for spectral sensitization, to obtain Emulsion 1.

200 ml of water was added to 900 g of Emulsion A and kept at 50° C., and then an aqueous silver nitrate solution (corresponding to 7 g of $AgNO_3$) and an aqueous sodium chloride solution were added thereto by a double jet method keeping the silver potential at +160 mV, whereby protrusions were formed on the surface of the grain matrixes. Afterwards, 120 ml of 1/250 mol/l Dye D-13 was added thereto. Next, the resulting emulsion was chemically sensitized with a hypo for 20 minutes at 50° C., to obtain Emulsion 2.

900 g of Emulsion A was kept at 50° C. and chemically sensitized with a hypo for 20 minutes, and then an aqueous silver nitrate solution (corresponding to 7 g of $AgNO_3$) and an aqueous sodium chloride solution were added thereto by a double jet method keeping the silver potential at +160 mV, whereby protrusions were formed on the surface of the grain matrix. Afterwards, 120 ml of 1/250 mol/l Dye D-13 was added for spectral sensitization, to obtain Emulsion 3.

The respective emulsion grains were observed with an electron microscope to count the number of protru- These samples were left under the conditions of 40° C. and relative humidity of 70% for 14 hours and then exposed for sensitometry and thereafter subjected to color development as described below.

The density of the thus processed sample was measured with a green filter.

The photographic sensitivity was represented by the reciprocal of the exposure necessary for obtaining an optical density of a fog value +0.2.

The development procedure was carried out by the following steps, which were carried out at 38° C.

| | |
|---|---|
| 1. Color Development | 2 min. 45 sec. |
| 2. Bleaching | 6 min. 30 sec. |
| 3. Rinsing in Water | 3 min. 15 sec. |
| 4. Fixing | 6 min. 30 sec. |
| 5. Rinsing in Water | 3 min. 15 sec. |
| 6. Stabilization | 3 min. 15 sec. |

The processing solutions used in the respective steps had the following compositions.

| | |
|---|---|
| Color Developer: | |
| Nitrilotriacetic Acid Sodium Salt | 1.0 g |
| Sodium Sulfite | 4.0 g |
| Sodium Carbonate | 30.0 g |
| Potassium Bromide | 1.4 g |
| Hydroxylamine Sulfate | 2.4 g |
| 4-(N—ethyl-N—β-hydroxylethylamino)-2-methyl-aniline Sulfate | 4.5 g |
| Water to make | 1 liter |
| Bleaching Solution: | |
| Ammonium Bromide | 160.0 g |
| Aqueous Ammonia (28 wt %) | 25.0 ml |
| Sodium Ethylenediamine-tetraacetic Acid Iron Complex | 130 g |
| Glacial Acetic Acid | 14 ml |

-continued

| | |
|---|---|
| Water to make | 1 liter |
| Fixing Solution: | |
| Sodium Tetrapolyphosphate | 2.0 g |
| Sodium Sulfite | 4.0 g |
| Ammonium Thiosulfate (70 wt %) | 175.0 ml |
| Sodium bisulfite | 4.6 g |
| Water to make | 1 liter |
| Stabilizer: | |
| Formalin | 8.0 ml |
| Water to make | 1 liter |

The results obtained are shown in Table 1 below. The results indicate that the grains of the emulsions of the present invention could maintain their shape and are photographically useful.

TABLE 1

| Emulsion No. (Sample No.) | Process After Formation of Grain Matrixes | Number of Protrusions of 0.15 μm or less (number/μm² of the grain matrix | Photographic Characteristics Dmin | (*)$S_{0.2}$ |
|---|---|---|---|---|
| 1 (Comparison) | Formation of Protrusions ↓ Chemical Sensitization ↓ Addition of Dye | 0 | 0.06 | 100 |
| 2 (Comparison) | Formation of Protrusions ↓ Addition of Dye ↓ Chemical Sensitization | 80 | 0.12 | 125 |
| 3 (Present Invention) | Chemical Sensitization ↓ Formation of Protrusions ↓ Addition of Dye | 115 | 0.06 | 180 |

(*)$S_{0.2}$: This means a relative sensitivity at an image density of 0.2, which is based on the sensitivity of Sample No. 1 being taken as 100.

EXAMPLE 2

200 ml of water was added to 900 g of Emulsion A and kept at 50° C., and an aqueous silver nitrate solution (corresponding to 7 g of $AgNO_3$) and an aqueous sodium chloride solution were added thereto by a double jet method keeping the silver potential at +120 mV, whereby protrusion were formed on the surface of the grain matrixes. Afterwards, the grains were chemically sensitized with a hypo at 60° C. for 20 minutes, and then 120 ml of 1/250 mol/l Dye D-9 mentioned above was added thereto for spectral sensitization to give Emulsion 4.

200 ml of water was added to 900 g of Emulsion A and kept at 50° C., and an aqueous silver nitrate solution (corresponding to 7 g of $AgNO_3$) and an aqueous sodium chloride solution were added thereto by a double jet method keeping the silver potential at +120 mV, whereby protrusions were formed on the surface of the grain matrixes. Afterwards, 25 ml of 1/50 mol/l 1-phenyl-5-mercaptotetrazole was added thereto, and then the grains were chemically sensitized with a hypo at 60° C. for 20 minutes. Next, 120 ml of 1/250 mol/l Dye D-9 mentioned above was added thereto for spectral sensitization to give Emulsion 5.

900 g of Emulsion A was kept at 60° C. and chemically sensitized with a hypo for 20 minutes, and then an aqueous silver nitrate solution (corresponding to 7 g of $AgNO_3$) and an aqueous sodium chloride solution were added thereto to 50° C. by a double jet method keeping the silver potential at +120 mV, whereby protrusions were formed on the surface of the grain matrixes. Afterwards, 120 ml of 1/250 mol/l Dye D-9 was added thereto for spectral sensitization to give Emulsion 6.

The respective emulsion grains were observed with an electron microscope to count the number of the protrusion having a diameter of 0.15 μm or less formed.

Next, photographic material samples Nos. 4 to 6 coated with the above-mentioned Emulsions 4 to 6, respectively, were formed in the same manner as in Example 1, and the photographic characteristics of the samples were also examined. The amount of the dye adsorbed was estimated from reflection spectrum of the emulsion and Kubelka-Munk's formula.

The results obtained are shown in Table 2 below. The results indicate that the grains of the emulsion of the present invention could maintain their shape thereof and could also maintain the amount of the dye adsorbed thereto.

TABLE 2

| Emulsion No. (Sample No.) | Process After Formation of Grain Matrixes | Number of Protrusions of 0.15 μm or less (number/μm² of the grain matrix | Amount of Dye Adsorbed (*) | Photographic Characteristics Dmin | $S_{0.2}$(**) |
|---|---|---|---|---|---|
| 4 (Comparison) | Formation of Protrusions ↓ Chemical Sensitization ↓ Addition of Dye | 0 | 100 | 0.07 | 100 |
| 5 (Comparison) | Formation of Protrusions ↓ Addition of Grain Formation-stopping Agent ↓ Chemical Sensitization ↓ | 35 | 20 | 0.03 | 30 |

TABLE 2-continued

| Emulsion No. (Sample No.) | Process After Formation of Grain Matrixes | Number of Protrusions of 0.15 μm or less (number/μm² of the grain matrix | Amount of Dye Adsorbed (*) | Photographic Characteristics Dmin | $S_{0.2}$(**) |
|---|---|---|---|---|---|
| 6 (Present Invention) | Addition of Dye<br>Chemical Sensitization<br>↓<br>Formation of Protrusions<br>↓<br>Addition of Dye | 38 | 115 | 0.08 | 130 |

(*): This means a relative amount based on the amount of Sample 4 being taken as 100.
(**): This means a relative sensitivity based on the sensitivity of Sample 4 taken as being 100

EXAMPLE 3

A silver nitrate solution and a mixture solution comprising potassium bromide and potassium iodide were added with stirring by a double jet method to a solution formed by dissolving potassium bromide, potassium iodide and gelatin and kept at 75° C. Subsequently, a silver nitrate solution and a potassium bromide solution were added thereto by a double jet method.

After the completion of the addition, the temperature was lowered to 35° C. and the soluble salts were removed by a sedimentation method, and then the temperature was again elevated to 40° C. Afterwards, 60 g of gelatin was added and dissolved, and the pH was adjusted to 6.8 to obtain a grain matrix emulsion B. The thus prepared grain matrixes were tabular and had an average grain diameter of 1.7 μm and an average grain thickness of 15 μm. 200 ml of water was added to Emulsion B (which corresponds to 70 g of $AgNO_3$) and kept at 45° C., and then an aqueous silver nitrate solution (corresponding to 7 g of $AgNO_3$) and an aqueous sodium chloride solution were added thereto by a double jet method keeping the silver potential at +160 mV, whereby protrusion were formed on the surface of the grain matrixes.

Afterwards, the grains were chemically sensitized with a hypo and a chloroauric acid, for 40 minutes at 50° C. to obtain Emulsion 7.

900 g of Emulsion B was kept at 50° C. and then chemically sensitized with a hypo and a chloroauric acid for 40 minutes, and thereafter an aqueous silver nitrate solution (corresponding to 7 g of $AgNO_3$) and an aqueous sodium chloride solution were added thereto by a double jet method keeping the silver potential at +160 mV, whereby protrusions were formed on the surface of the grain matrixes to obtain Emulsion 8.

The Emulsions 7 and 8 were individually coated on a cellulose triacetate film support coated with a subbing layer, to give multilayer color photographic material sample Nos. 7 and 8, respectively, having the layers described below.

Compositions of Light-Sensitive Layers:

Regarding the amount of the respective components as coated, the silver halide and colloidal silver are represented by the units of g/m² as silver coated; the coupler, additives and gelatin are represented by the units of g/m²; and the sensitizing dye is represented by the number of mols per mol of the silver halide in the same layer.

| | |
|---|---|
| First Layer: Anti-halation Layer | |
| Black Colloidal Silver | 0.2 (as Ag) |
| Gelatin | 1.3 |
| Colored Coupler C-1 | 0.06 |
| Ultraviolet Absorbent UV-1 | 0.1 |
| Ultraviolet Absorbent UV-2 | 0.2 |
| Dispersion Oil Oil-1 | 0.01 |
| Dispersion Oil Oil-2 | 0.01 |
| Second Layer: Interlayer | |
| Fine Silver Bromide Grains (average grain size: 0.07 μm) | 0.15 (as Ag) |
| Gelatin | 1.0 |
| Colored Coupler C-2 | 0.02 |
| Dispersion Oil Oil-1 | 0.1 |
| Third Layer: First Red-sensitive Emulsion Layer | |
| Silver Iodobromide Emulsion (silver iodide 2 mol %, average grain size: 0.3 μm) | 0.4 (as Ag) |
| Gelatin | 0.6 |
| Sensitizing Dye I | $1.0 \times 10^{-4}$ |
| Sensitizing Dye II | $3.0 \times 10^{-4}$ |
| Sensitizing Dye III | $1.0 \times 10^{-5}$ |
| Coupler C-3 | 0.06 |
| Coupler C-4 | 0.06 |
| Coupler C-8 | 0.04 |
| Coupler C-2 | 0.03 |
| Dispersion Oil Oil-1 | 0.03 |
| Dispersion Oil Oil-3 | 0.012 |
| Fourth Layer: Second Red-sensitive Emulsion Layer | |
| Silver Iodobromide Emulsion (silver iodide 5 mol %, average grain size 0.5 μm) | 0.7 (as Ag) |
| Sensitizing Dye I | $1.0 \times 10^{-4}$ |
| Sensitizing Dye II | $3.0 \times 10^{-4}$ |
| Sensitizing Dye III | $1.0 \times 10^{-5}$ |
| Coupler C-3 | 0.24 |
| Coupler C-4 | 0.24 |
| Coupler C-8 | 0.04 |
| Coupler C-2 | 0.04 |
| Dispersion Oil Oil-1 | 0.15 |
| Dispersion Oil Oil-3 | 0.02 |
| Fifth Layer: Third Red-sensitive Emulsion Layer | |
| Emulsion 7 or 8 | 1.0 (as Ag) |
| Gelatin | 1.0 |
| Sensitizing Dye I | $1.0 \times 10^{-4}$ |
| Sensitizing Dye II | $3.0 \times 10^{-4}$ |
| Sensitizing Dye III | $1.0 \times 10^{-5}$ |
| Coupler C-6 | 0.05 |
| Coupler C-7 | 0.1 |
| Dispersion Oil Oil-1 | 0.01 |
| Dispersion Oil Oil-2 | 0.05 |
| Sixth Layer: Interlayer | |
| Gelatin | 1.0 |
| Compound Cpd-A | 0.03 |
| Dispersion Oil Oil-1 | 0.05 |
| Seventh Layer: First Green-sensitive Emulsion Layer | |
| Silver Iodobromide Emulsion (silver iodide 4 mol %, average grain size: 0.3 μm) | 0.30 (as Ag) |
| Sensitizing Dye IV | $5.0 \times 10^{-4}$ |
| Sensitizing Dye V | $2.0 \times 10^{-4}$ |
| Sensitizing Dye VI | $0.3 \times 10^{-4}$ |
| Gelatin | 1.0 |
| Coupler C-9 | 0.2 |
| Coupler C-5 | 0.03 |
| Coupler C-1 | 0.03 |

-continued

| | |
|---|---|
| Dispersion Oil Oil-1 | 0.5 |
| Eighth Layer: Second Green-sensitive Emulsion Layer | |
| Silver Iodobromide Emulsion (silver iodide 5 mol %, average grain size: 0.5 μm) | 0.4 (as Ag) |
| Sensitizing Dye IV | $5.0 \times 10^{-4}$ |
| Sensitizing Dye V | $2.0 \times 10^{-4}$ |
| Sensitizing Dye VI | $0.3 \times 10^{-4}$ |
| Coupler C-9 | 0.25 |
| Coupler C-1 | 0.03 |
| Coupler C-10 | 0.015 |
| Coupler C-5 | 0.01 |
| Dispersion Oil Oil-1 | 0.2 |
| Ninth Layer: Third Green-sensitive Emulsion Layer | |
| Emulsion 7 or 8 | 0.85 (as Ag) |
| Gelatin | 1.0 |
| Sensitizing Dye VII | $3.5 \times 10^{-4}$ |
| Sensitizing Dye VIII | $1.4 \times 10^{-4}$ |
| Coupler C-11 | 0.01 |
| Coupler C-12 | 0.03 |
| Coupler C-13 | 0.20 |
| Coupler C-1 | 0.02 |
| Coupler C-15 | 0.02 |
| Dispersion Oil Oil-1 | 0.20 |
| Dispersion Oil Oil-2 | 0.05 |
| Tenth Layer: Yellow Filter Layer | |
| Gelatin | 1.2 |
| Yellow Colloidal Layer | 0.08 |
| Compound Cpd-B | 0.1 |
| Dispersion Oil Oil-1 | 0.3 |
| Eleventh Layer: First Blue-sensitive Emulsion Layer | |
| Monodispersed Silver Iodobromide Emulsion (silver iodide 4 mol %, average grain size: 0.3 μm) | 0.4 (as Ag) |

-continued

| | |
|---|---|
| Gelatin | 1.0 |
| Sensitizing Dye IX | $2.0 \times 10^{-4}$ |
| Coupler C-14 | 0.9 |
| Coupler C-5 | 0.07 |
| Dispersion Oil Oil-1 | 0:2 |
| Twelfth Layer: Second Blue-sensitive Emulsion Layer | |
| Emulsion 7 or 8 | 0.5 (as Ag) |
| Gelatin | 0.6 |
| Sensitizing Dye IX | $1.0 \times 10^{-4}$ |
| Coupler C-14 | 0.25 |
| Dispersion Oil Oil-1 | 0.07 |
| Thirteenth Layer: First Protective Layer | |
| Gelatin | 0.8 |
| Ultraviolet Absorbent UV-1 | 0.1 |
| Ultraviolet Absorbent UV-2 | 0.2 |
| Dispersion Oil Oil-1 | 0.01 |
| Dispersion Oil Oil-2 | 0.01 |
| Fourteenth Layer: Second Protective Layer | |
| Fine Silver Bromide Grains (mean grain size: 0.07 μm) | 0.5 (as Ag) |
| Gelatin | 0.45 |
| Polymethyl Methacrylate Grains (diameter: 1.5 μm) | 0.2 |
| Hardener H-1 | 0.4 |
| Formaldehyde Scavenger S-1 | 0.5 |
| Formaldehyde Scavenger S-2 | 0.5 |

In addition to the above-mentioned components, a surfactant was added to the respective layers as a coating aid.

Chemical structural formulae or chemical names of the compounds used in the above-mentioned layers are shown below.

UV-1:

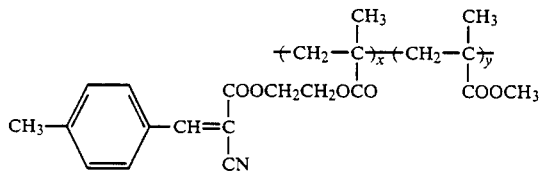

x/y = 7/3 (by weight)

UV-2:

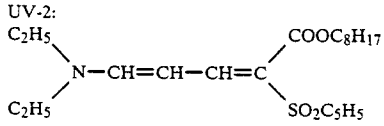

| | |
|---|---|
| Oil-1: | Tricresyl Phosphate |
| Oil-2: | Dibutyl Phthalate |
| Oil-3: | Bis(2-ethylhexyl) Phthalate |

C-1:

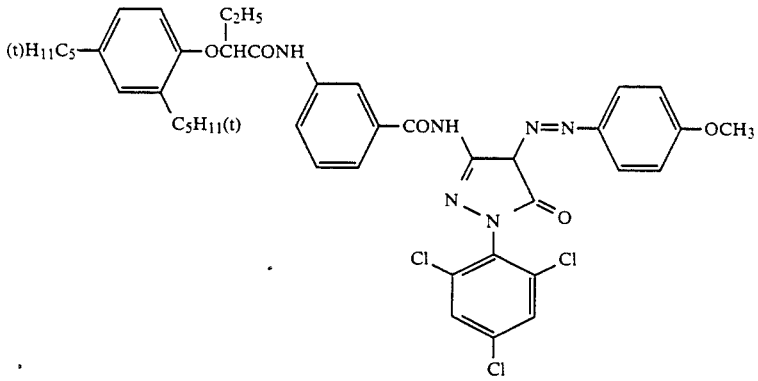

-continued
C-2:
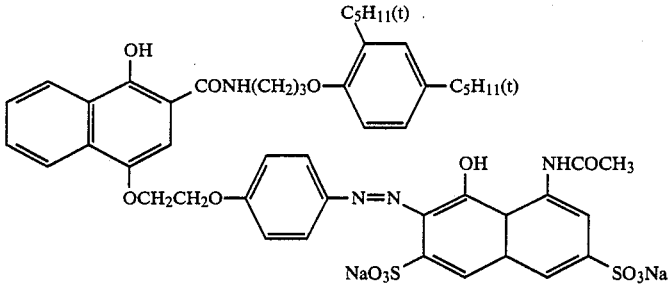
C-3:
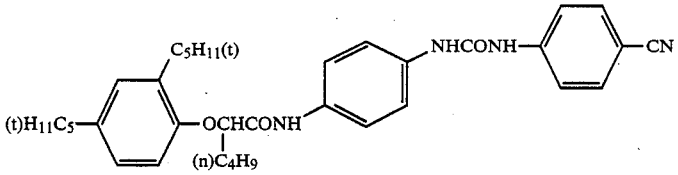
C-4:
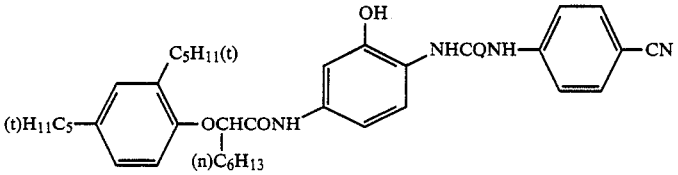
C-5:
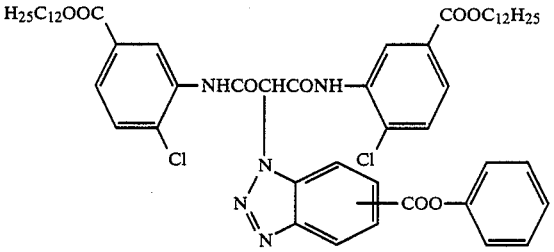
C-6:
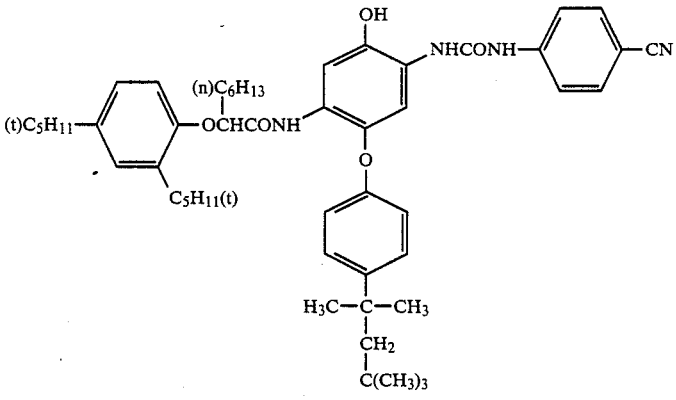
C-7:
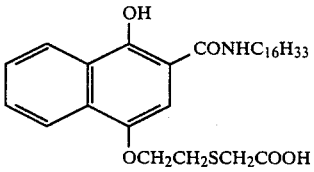

-continued
C-8:
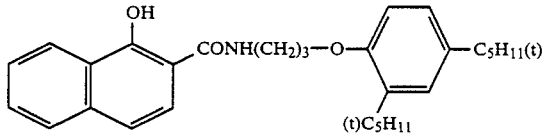
C-9:
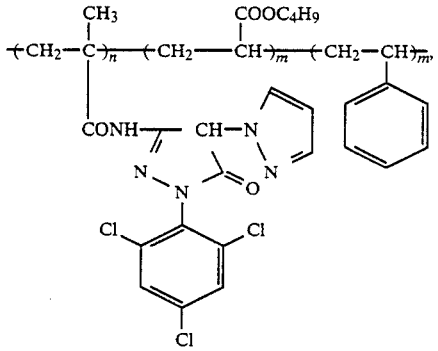
n = 50, m = 25, m' = 25
mol. wt. About 20,000
C-10:
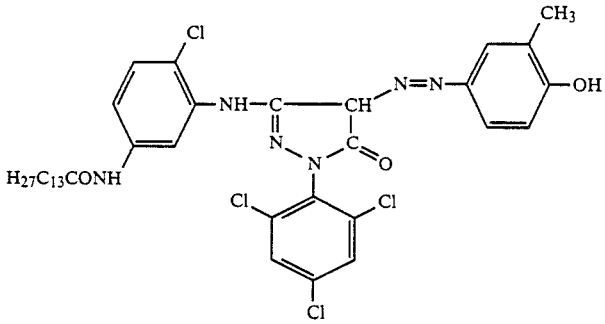
C-11:
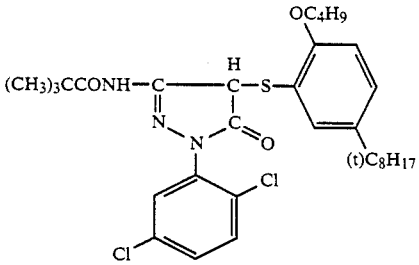
C-12:
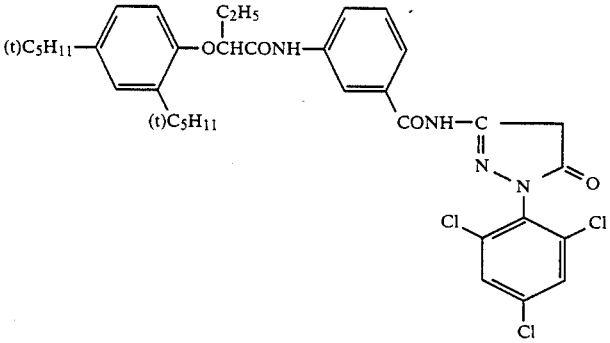
C-13:

-continued
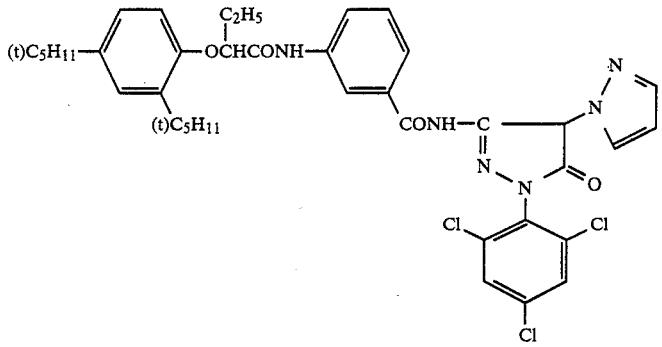
C-14:
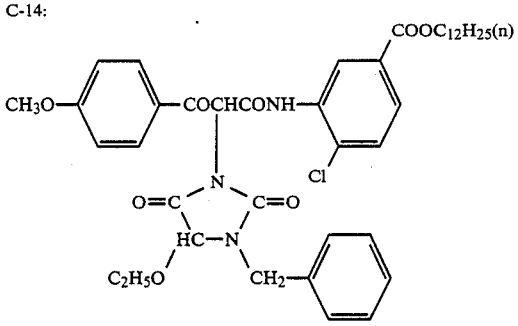
C-15:
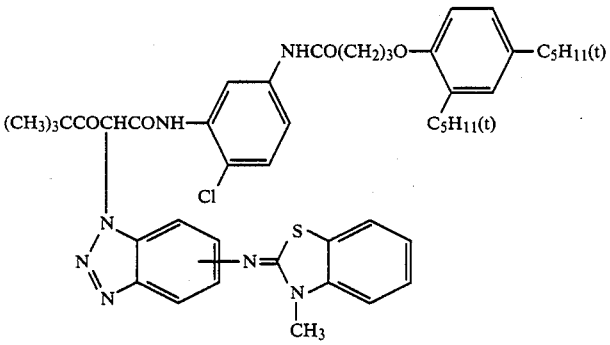
Cpd A:
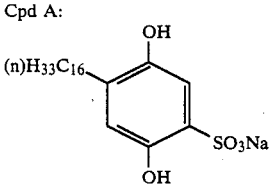
Cpd B:
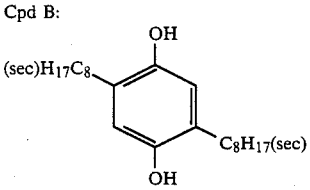
Sensitizing Dye I:
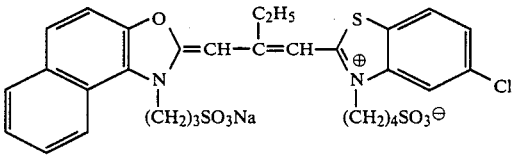

-continued
Sensitizing Dye II:
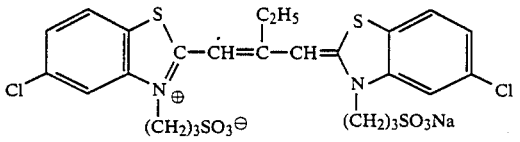
Sensitizing Dye III:
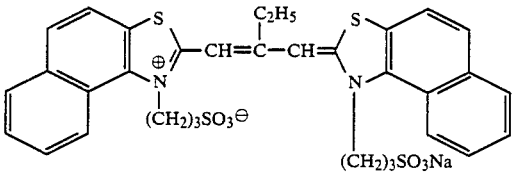
Sensitizing Dye IV:
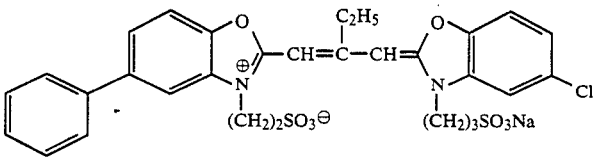
Sensitizing Dye V:
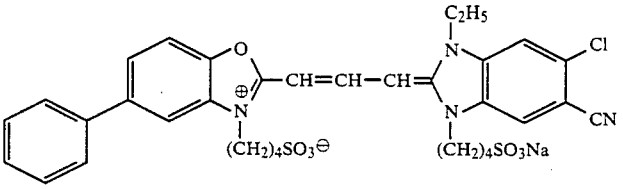
Sensitizing Dye VI:
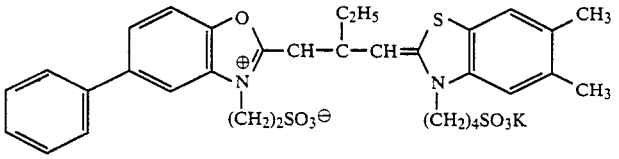
Sensitizing Dye VII:
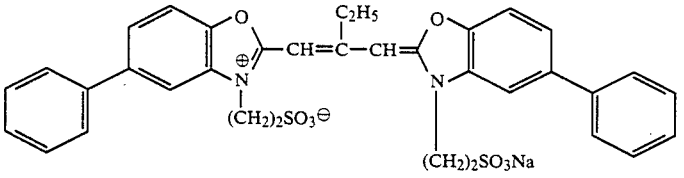
Sensitizing Dye VIII:
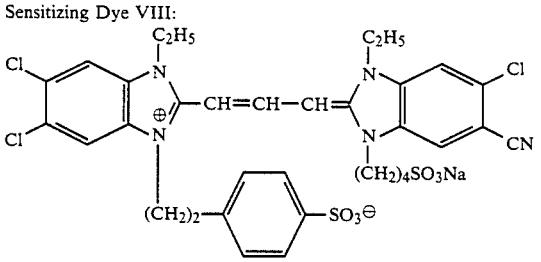
Sensitizing Dye IX:
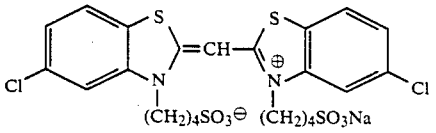

-continued

H-1:

$$\begin{array}{l} CH_2{=}CH{-}SO_2{-}CH_2{-}CONH{-}CH_2 \\ \qquad\qquad\qquad\qquad\qquad\qquad\quad | \\ CH_2{=}CH{-}SO_2{-}CH_2{-}CONH{-}CH_2 \end{array}$$

S-1:

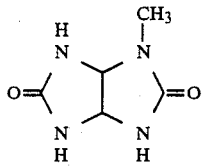

S-2:

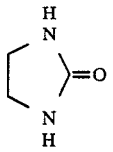

The photographic material samples thus-prepared were exposed with a tungsten lamp (25 CMS, color temperature of 4800°K) through a filter, and then developed at 38° C. in accordance with the following procedure.

| | |
|---|---|
| Color Development | 3 min. 15 sec. |
| Bleaching | 6 min. 30 sec. |
| Rinsing in Water | 2 min. 10 sec. |
| Fixing | 4 min. 20 sec. |
| Rinsing in Water | 3 min. 15 sec. |
| Stabilization | 1 min. 05 sec. |

The processing solutions used in the respective steps were as follows:

| | |
|---|---|
| Color Developer: | |
| Diethylenetriamine-pentaacetic Acid | 1.0 g |
| 1-Hydroxyethylidene-1,1-diphosphonic Acid | 2.0 g |
| Sodium Sulfite | 4.0 g |
| Potassium Carbonate | 30.0 g |
| Potassium Bromide | 1.4 g |
| Potassium Iodide | 1.3 mg |
| Hydroxylamine Sulfate | 2.4 g |
| 4-(N—ethyl-N—β-hydroxyethylamino)-2-methylaniline Sulfate | 4.5 g |
| Water to make | 1.0 liter |
| | pH 10.0 |
| Bleaching Solution: | |
| Ammonium Ethylenediamine-tetraacetic Acid Ferric Complex | 100.0 g |
| Ethylenediamine-tetraacetic Acid Disodium Salt | 10.0 g |
| Ammonium Bromide | 150.0 g |
| Ammonium Nitrate | 10.0 g |
| Water to make | 1.0 liter |
| | pH 6.0 |
| Fixing Solution: | |
| Ethylenediamine-tetraacetic Acid Disodium Salt | 1.0 g |
| Sodium Sulfite | 4.0 g |
| Aqueous Ammonium Thiosulfate Solution (70 wt %) | 175.0 ml |
| Sodium Bisulfite | 4.6 g |
| Water to make | 1.0 liter |
| | pH 6.6 |
| Stabilizer Solution: | |
| Formalin (40 wt %) | 2.0 ml |
| Polyoxyethylene-p-monononylphenyl Ether (average polymerization degree of 10) | 0.3 g |

-continued

| | |
|---|---|
| Water to make | 1.0 liter |

It was confirmed that sample No. 8 having Emulsion 8 of the present invention had a higher sensitivity than sample No. 7 having comparative Emulsion 7. Example 3 demonstrates that the present invention is extremely effective also in a multilayer color photographic material.

While the invention has been described in detail and with reference to specific embodiments thereof, it will be apparent to one skilled in the art that various changes and modifications can be made therein without departing from the spirit and scope thereof.

What is claimed is:

1. A method for preparing a silver halide photographic emulsion comprising silver halide grains having silver halide protrusions on the surface of a silver halide grain matrix which comprises the steps of:

forming the silver halide grain matrix with a grain matrix composition comprised of AgBr, AgBrCl, AgBrI, or AgBrICl, chemically sensitizing the silver halide grain matrix, then forming the silver halide protrusions on the surface of the chemically sensitized silver halide grain matrix with a silver halide protrusion composition comprised of AgBr, AgCl, AgBrCl, AgBrI, AgClI or AgBrClI, by employing a high silver potential of about +110 mV or more, to provide the protrusions with a size of 0.15 μm or less as the diameter of the projected area of the protrusions and to provide the protrusions in a number of from 10 to 10,000 per unit area ($\mu m^2$) of the grain matrix, and spectrally sensitizing the silver halide photographic emulsion.

2. A method for preparing a silver halide photographic emulsion as in claim 1, wherein the halogen composition of the grain matrix is different from that of the protrusions.

3. A method for preparing a silver halide photographic emulsion as in claim 1, wherein the grain matrix having a (111) plane constitutes 50% or more of the total surface of the grain matrix.

4. A method for preparing a silver halide photographic emulsion as in claim 1, wherein the grain matrix are tabular grains having an aspect ratio of from 5/1 to 20/1.

5. A method for preparing a silver halide photographic emulsion as in claim 1, wherein the silver halide grain matrix comprises AgBr or AgBrI containing 10 mol % or less $I^{\ominus}$, and the silver halide protrusions comprises AgCl or AgBrCl containing 50 mol % or more $Cl^{\ominus}$.

6. A method for preparing a silver halide photographic emulsion as in claim 1, wherein the chemical sensitization is carried out by at least one of a sulfur sensitization method, a selenium sensitization method, a reduction sensitization or a noble metal sensitization method.

7. A method for preparing a silver halide photographic emulsion as in claim 6, wherein the chemical sensitization is carried out with at least one of a gold sensitizer or a sulfur sensitizer.

8. A method for preparing a silver halide photographic emulsion as in claim 1, wherein the number of the protrusions is from 20 to 10,000 per unit area ($\mu m^2$) of the grain matrix.

9. A method for preparing a silver halide photographic emulsion as in claim 1, wherein the silver halide grains are spectrally sensitized with a methine dye.

10. A method for preparing a silver halide photographic emulsion as in claim 1, wherein the grain matrix comprises AgBr or AgBrI and the protrusions comprise AgCl or AgBrCl containing 30 mol % or more chloride ion.

11. The method according to claim 1, wherein the protrusions are formed with a halogen composition which differs from that of the grain matrix.

* * * * *